US006653766B2

(12) United States Patent
Hori

(10) Patent No.: US 6,653,766 B2
(45) Date of Patent: Nov. 25, 2003

(54) SPARK PLUG AND METHOD OF MANUFACTURING SAME

(75) Inventor: Tsunenobu Hori, Kariya (JP)

(73) Assignee: Denso Corporation, Kariya (JP)

( * ) Notice: Subject to any disclaimer, the term of this patent is extended or adjusted under 35 U.S.C. 154(b) by 44 days.

(21) Appl. No.: 09/851,988

(22) Filed: May 10, 2001

(65) Prior Publication Data

US 2002/0050775 A1 May 2, 2002

(30) Foreign Application Priority Data

May 12, 2000 (JP) ..... 2000-140556
Mar. 1, 2001 (JP) ..... 2001-057258

(51) Int. Cl.[7] ..... H01T 13/20
(52) U.S. Cl. ..... 313/141; 445/7; 313/144
(58) Field of Search ..... 313/141, 142, 313/143, 137, 144, 145, 118, 130; 445/7

(56) References Cited

U.S. PATENT DOCUMENTS 4,893,051 A 1/1990 Kondo
5,440,198 A 8/1995 Oshima et al.
5,510,667 A * 4/1996 Loffler et al. ..... 313/141
5,574,329 A * 11/1996 Kagawa ..... 313/141
5,793,793 A * 8/1998 Matsutani et al. ..... 313/141
5,831,377 A * 11/1998 Matsubara et al. ..... 313/141
5,856,724 A * 1/1999 Chiu et al. ..... 313/141
5,877,584 A * 3/1999 Kato et al. ..... 313/143
6,078,129 A 6/2000 Gotou et al.
6,215,235 B1 * 4/2001 Osamura ..... 313/141

FOREIGN PATENT DOCUMENTS

JP 59-2152 1/1984
JP 6-36856 2/1994
JP 11-3765 1/1999

* cited by examiner

*Primary Examiner*—David Martin
*Assistant Examiner*—Thanh S. Phan
(74) *Attorney, Agent, or Firm*—Nixon & Vanderhye P.C.

(57) ABSTRACT

A spark plug for an engine comprises a mounting member to be mounted to an engine, an insulator disposed inside the mounting member and formed with an axial hole, a center electrode formed of a metal material and disposed in the axial hole of the insulator in a manner insulated from the mounting member, and an earth electrode disposed so as to oppose to the center electrode. At least one of the center electrode and earth electrode is formed as a base material having one surface to which a tip composed, as a discharge member, of a noble metal or alloy thereof is welded and fixed thereto through a fused portion. The fused portion between the tip and the base material has an area of a maximum sectional area portion of a size of not more than 1.5 times a sectional area of a portion of the tip positioned at a boundary portion to the fused portion, and the sectional area of the tip positioned at the boundary portion is not less than 2 $mm^2$ and not more than 7 $mm^2$.

9 Claims, 14 Drawing Sheets

| | φD | SECTIONAL AREA RATIO OF MAXIMUM PORTION OF FUSED PORTION TO TIP |
|---|---|---|
| ① | φ2.4 | 1 (SAME SECTIONAL AREA SHAPE/DIMENSION) |
| ② | φ2.6 | 1.17 |
| ③ | φ2.8 | 1.36 |
| ④ | φ3.0 | 1.56 |
| ⑤ | φ3.2 | 1.78 (CONVENTIONAL PRODUCT) |

| ϕDmin (MINIMUM SECTIONAL AREA PORTION) | SECTIONAL AREA RATIO OF MINIIMUM PORTION OF FUSED PORTION TO TIP |
|---|---|
| ϕ1.4 | 0.34 |
| ϕ1.6 | 0.44 |
| ϕ1.8 | 0.56 |
| ϕ2.0 | 0.69 |
| ϕ2.2 | 0.84 |
| ϕ2.4 | 1.0 (CONVENTIONAL PRODUCT) |

SPARK PLUG AND METHOD OF MANUFACTURING SAME

BACKGROUND OF THE INVENTION

The present invention relates to a spark plug and a method of manufacturing the same, in which at least one of electrodes of center electrode and earth electrode, which are disposed so as to oppose to each other, is formed as a base material and a tip as a discharge material formed of noble metal or its alloy is welded to one surface of the base material and fixed thereto and also relates to a method of manufacturing such spark plug, which is particularly usable in a severe environment of such as thermal load of a cogeneration engine or like.

In a known art, life time and performance of a spark plug have been improved by welding and fixing a tip, formed of a noble metal or its alloy such as Ir, Pt or like as a discharge member performing spark discharge, to a center electrode or an earth electrode (base material). A resistance welding is generally utilized for such tip joining method in a viewpoint of easy manufacturing, low cost, or like. However, in the case of using Ir alloy as the tip, since the Ir alloy has a linear expansion coefficient with respect to the base material larger than the case of Pt alloy, it is difficult to ensure joining reliability between the tip and the base material in the resistance welding method.

Because of the reason mentioned above, in the prior art, in the case where the tip formed of the Ir alloy is joined (welded), an alloy layer (relaxation layer) formed by melting the Ir alloy and the base material (Ni alloy or like) between these materials is formed by means of laser welding thereby to attenuate a thermal stress applied to the joining portion between the tip and the base material, thus ensuring the joining reliability between the tip and the base material.

However, in an experience of the inventor of the subject application, the thermal stress has been increased in the case of using the spark plug under a condition of large-sized tip or severe thermal environment (for example, in a cogeneration engine, temperature of the center electrode increases to about 950° C.) regardless of the kind of the welding methods such as laser welding, resistance welding or like. In an adverse case, the tip may fall down from the base material, thus providing a problem.

SUMMARY OF THE INVENTION

An object of the present invention is to substantially eliminate defects or drawbacks encountered in the prior art mentioned above and to provide a spark plug capable of ensuring the joining (welding) reliability between a tip and a base material even in a severe thermal stress or load environment.

Another object of the present invention is to provide a method of manufacturing the spark plug of the character mentioned above in a manner easily performed.

These and other objects can be achieved according to the present invention by providing, in one aspect, a spark plug for an engine comprising:

a mounting member made of a conductive material which is mounted to an engine;

an insulator disposed inside the mounting member and formed with an axial hole;

a center electrode formed of a metal material and disposed in the axial hole of the insulator in a manner insulated from the mounting member; and an earth electrode disposed so as to oppose to the center electrode, at least one of the center electrode and earth electrode being formed as a base material having one surface to which a tip composed, as a discharge member, of a noble metal or alloy thereof is welded and fixed thereto through a fused portion, wherein the fused portion between the tip and the base material has an area of a maximum sectional area portion of a size of not more than 1.5 times a sectional area of a portion of the tip positioned at a boundary portion to the fused portion, and the sectional area of the tip positioned at the boundary portion is not less than 2 $mm^2$ and not more than 7 $mm^2$.

Further, it is to be noted that the one surface of the base material to which the tip has been welded means or represents the surface of the base material in the state before the welding to the tip because, after the welding, this surface may not be clear for the formation of the fused portion, for example.

According to the invention of this aspect, the fused portion between the tip and the base material has an area of a maximum sectional area portion of a size of not more than 1.5 times a sectional area of a portion of the tip positioned at a boundary portion to the fused portion, and accordingly, the thermal stress to the fused portion can be reduced and even if the spark plug is used under the severe thermal load condition of a cogeneration engine, for example, the joining reliability between the tip and the base material can be effectively ensured. This effect can be further enhanced by the definition that the sectional area of the tip positioned at the boundary portion is not less than 2 $mm^2$ and not more than 7 $mm^2$.

In a preferred example of the above aspect, the fused portion has a minimum sectional area portion having an area of a size of not less than 0.6 time the sectional area of the tip positioned at the boundary portion to the fused portion. The base material has a sectional area, as a small sectional area portion, along one surface thereof, which has a size of not more than 1.5 times the sectional area of the portion of the tip positioned at the boundary portion to the fused portion, the small sectional area portion being formed so as to provide a formation length of not more than 2.0 mm in a direction normal to the one surface of the base material from the boundary portion between the base material and the fused portion.

The tip is fixed to the one surface of the base material through a laser welding. The tip is formed of an alloy including Ir of not less than 50 weight %.

According to the preferred example, the formation of the small sectional area portion makes reduce the size of the base material with respect to the fused portion, thus reducing the thermal stress. In the experiment of the inventors, the following facts have been revealed.

The small sectional are portion has a fine shape in comparison with other portions of the base material such as center electrode and/or earth electrode. If the formation length exceeds 2.0 mm, the base material will be made too fine to obtain a good thermal conductivity and the temperature increasing of the base material will increase the thermal stress to the fused portion as the result. Therefore, it is difficult to ensure the reliable joining performance. On the contrary, in the case of the formation length of not more than 2.0 mm, the temperature increasing of the base material will be suppressed and the thermal stress to the fused portion will be hence reduced, thus being advantageous.

Furthermore, according to the laser welding, the tip can be firmly fixed to the surface of the base material with a large thickness (i.e. for example, several hundreds μm to 1 mm) of the fused portion in comparison with the resistance welding. thus the tip being surely fixed.

Still furthermore, by forming the tip by using a metal material of such as Ir or its alloy of the weight % mentioned above, the tip can achieve more effective function with respect to the base material having a large difference of linear expansion coefficient.

In another aspect of the present invention, there is also provided a spark plug for an engine comprising:

a mounting member made of a conductive material which is mounted to an engine;

an insulator disposed inside the mounting member and formed with an axial hole;

a center electrode formed of a metal material and disposed in the axial hole of the insulator in a manner insulated from the mounting member; and an earth electrode disposed so as to oppose to the center electrode, at least one of the center electrode and earth electrode being formed as a base material having one surface to which a tip composed, as a discharge member, of a noble metal or alloy thereof is welded and fixed thereto through a fused portion, wherein the fused portion between the tip and the base material has a sectional area having shape and size substantially the same as those of a sectional area of a portion of the tip positioned at a boundary portion to the fused portion.

In the above aspect, if the tip and the fused portion have substantially the same shapes and/or dimensions in their sectional areas at the boundary portion between these tip and the fused portion, there will exist an extruded (extruding) portion of the tip or fused portion, and an edge portion will be formed at such extruded portion, to which the thermal stress is likely concentrated.

However, according to the present invention of the above aspect, since the tip and the fused portion have the same shape and/or dimension in their sectional area at the boundary portion therebetween, any edge portion of the type mentioned above never exist, thus reducing the thermal stress and ensuring the joining reliability between the tip and the base material even in the use under the severe thermal load condition such as in a coegeneration engine.

In a preferred example of the present invention of the above aspect, the base material has a sectional area, as a same-shaped portion, along one surface thereof, which has shape and size substantially the same as those of the sectional area of the fused portion, the same-shaped portion being formed so as to provide a formation length of not more than 2.0 mm in a direction normal to the one surface of the base material from the boundary portion between the base material and the fused portion.

The tip is fixed to the one surface of the base material through a laser welding. The tip is formed of an alloy including Ir of not less than 50 weight %.

According to such preferred example, the advantageous effects mentioned above in this and aforementioned aspects can be also achieved in more effective manner.

In a further aspect of the present invention, there is also provided a method of manufacturing a spark plug for an engine of the structures mentioned above in the one and another aspect of the present invention, the method comprising the steps of;

welding the tip to the one surface of the base material; and working the fused portion between the tip and the base material so as to provide a predetermined shape.

In a preferred example, the fused portion between the tip and the base material has an area of a maximum sectional area portion having a size of not more than 1.5 times a sectional area of a portion of the tip positioned at a boundary portion to the fused portion. The sectional area of the tip positioned at the boundary portion is not less than 2 $mm^2$ and not more than 7 $mm^2$.

The fused portion between the tip and the base material has a sectional area having shape and size substantially the same as those of a sectional area of a portion of the tip positioned at a boundary portion to the fused portion. The fused portion and the base material adjacent to the fused portion is subjected to a shaping working so as to provide a predetermined shape of the base material. The tip is fixed to the one surface of the base material through a laser welding.

According to the preferred example of this aspect, the shape and size of the sectional area of the fused portion between the tip and the base material can be adjusted and regulated, the desired fused portion can be formed, and hence, the spark plug of the desired structure can be manufactured.

The nature and further characteristic features of the present invention will be made further clear from the following descriptions in relation to effected experiments with reference to the accompanying drawings.

DESCRIPTION OF THE PREFERRED EMBODIMENTS

Preferred embodiments of the present invention will be described hereunder with reference to the accompanying drawings.

First Embodiment

Figure 1:
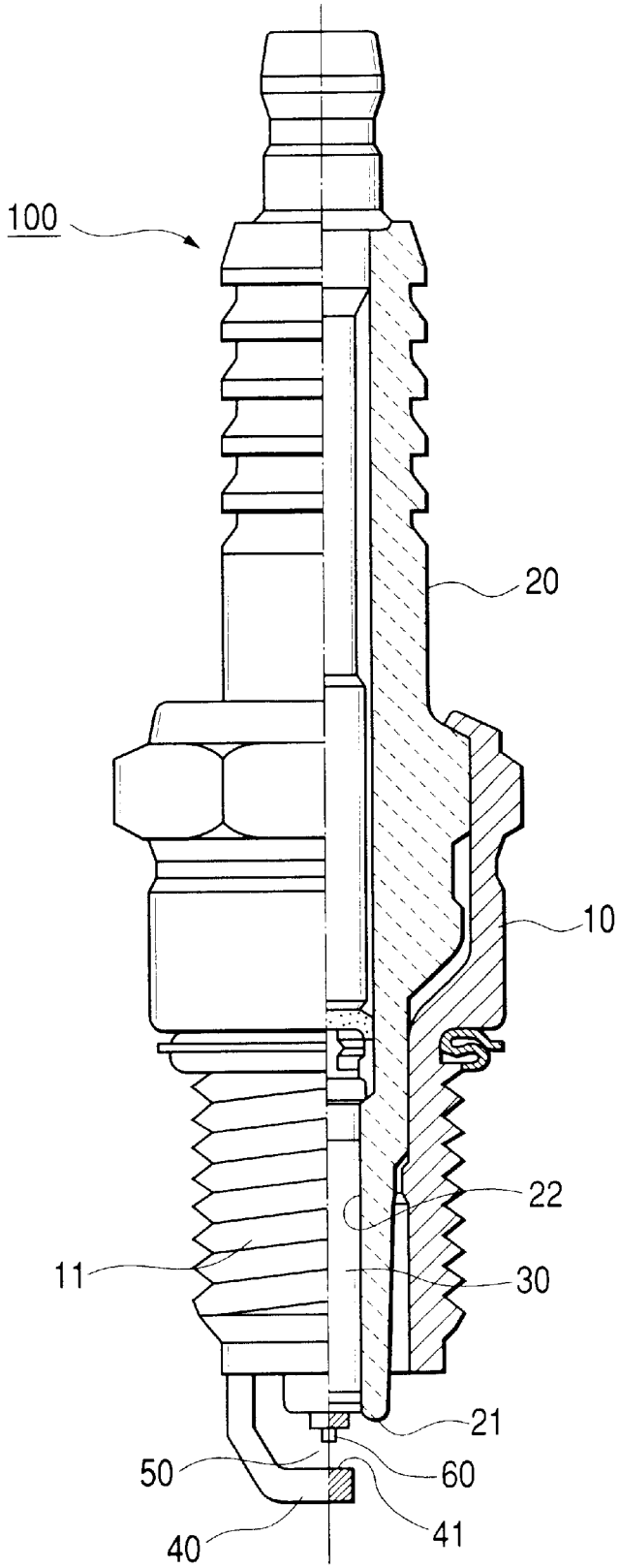
FIG. 1 is a front view, half in section, of a spark plug according to a first embodiment of the present invention.

FIG. 1 is a front view, vertical half in section, showing an entire structure of a spark plug according to a first embodiment of the present invention. A spark plug 100 is one usable as an ignition plug of an engine which is disposed in a severe condition such as severe thermal load of a cogeneration engine or like, and the spark plug 100 is fastened to a screw hole formed to an engine block, not shown, sectioning a combustion chamber of the engine.

The spark plug 100 is provided with a cylindrical mounting bracket or fitting 10 formed of a conductive iron-steel material such as low carbon steel. The mounting bracket 10 has a mount screw portion 11 for fastening the spark plug 100 to the engine block, and inside the mounting bracket 10, an insulator (insulating material) 20 formed of alumina-ceramic ($Al_2O_3$), for example, and the insulator 20 is mounted so that a front end portion 21 thereof (lower top end portion as viewed in FIG. 1) is exposed outside from the mounting bracket 10.

The insulator 20 has its axial hole 22 to which a center electrode 30 is fixedly fitted so as to be supported thereby in a manner insulated from the mounting bracket 10. The center electrode 30 comprises a cylindrical, i.e. columnar, member composed of an inner metal material such as Cu having an excellent thermal conduction and an outer metal material such as Ni base alloy having excellent heat resistance and corrosion resistance. As shown in FIG. 1, a front (top) end surface 31 (FIG. 3A) of the center electrode 30 projects outward from the front end portion 21 of the insulator 20.

On the other hand, the spark plug 100 is also provided with an earth (ground) electrode 40 having one end fixed to one end of the mounting bracket 10, through welding means, for example, and the earth electrode 40 is then bent in L-shape so that the other end 41 thereof opposes to the front end surface 31 of the center electrode 30 with a discharge gap 50 being interposed. The earth electrode 40 is composed of a columnar member formed of Ni base alloy mainly consisting of Ni, for example.

As mentioned above, the front end surface 31 of the center electrode 30 and the other end portion 41 of the earth electrode 40 are arranged so as to oppose to each other, and in the present embodiment, a tip 60 as a discharge member formed of a noble metal or its alloy is joined and fixed, through a laser welding process, to the front end surface 31 of the center electrode 30 as a base material.

In the described embodiment, the tip 60 is formed of an alloy containing a noble metal of iridium (Ir) of more than 50 weight % and has a disc shape in section along the front end surface 31 of the center electrode 30. In this meaning, the discharge gap 50 is a gap between the tip 60 and the other end surface 41 of the earth electrode 40.

Figure 2:
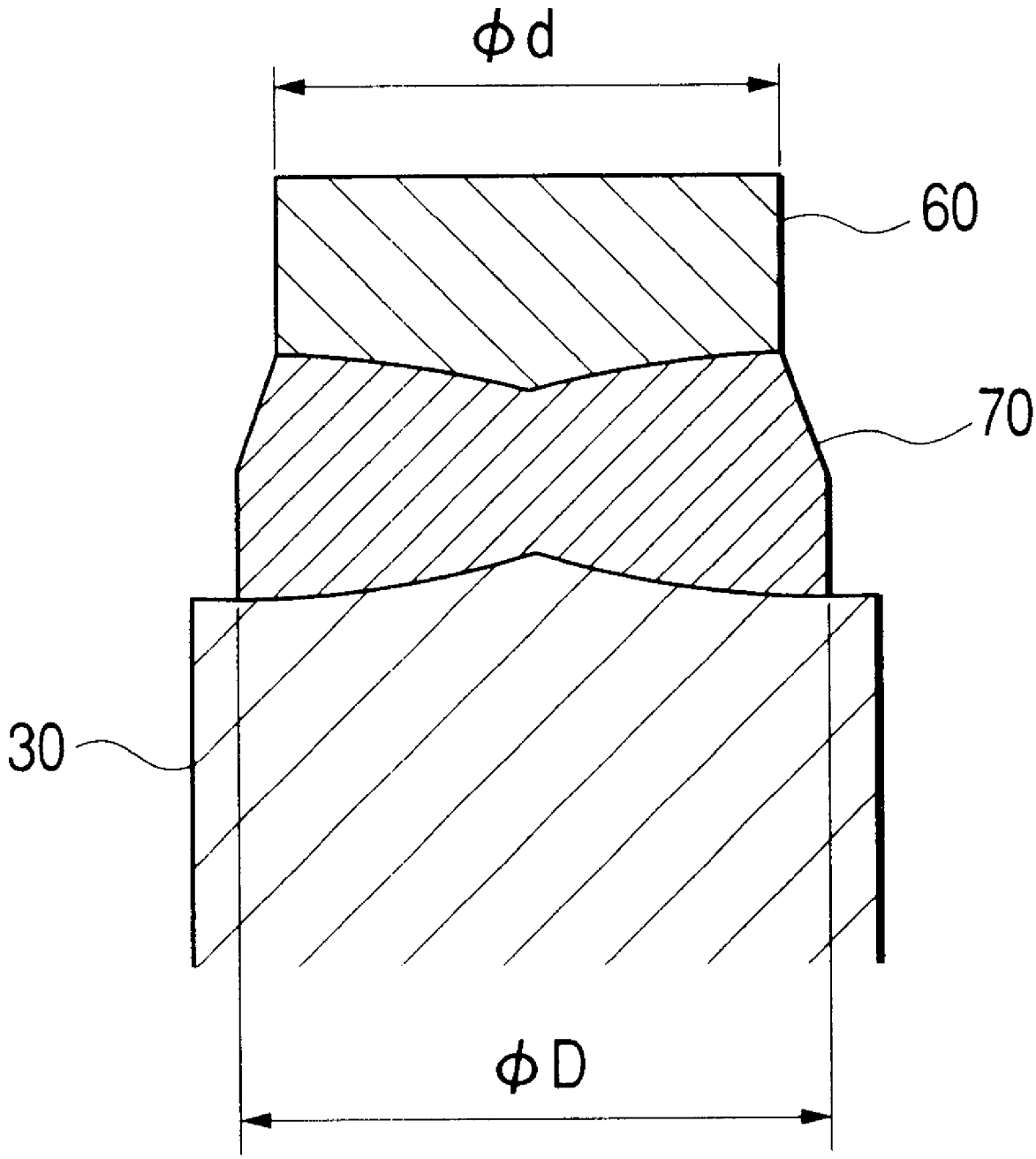
FIG. 2 is an illustration of a front portion of a center electrode, in an enlarged scale, of the spark plug shown in FIG. 1.

FIG. 2 is an illustration of a front end portion of the center electrode 30 in an enlarged scale.

With reference to FIG. 2, the tip 60 in shape of disc having a diameter of ϕd and the center electrode 30 having a circular columnar shape are joined together through a fused portion 70, which is composed of mixture of fused portions of the center electrode 30 and the tip 60 by means of laser welding. With reference to the sectional area along the front end surface 31 of the center electrode 30 (a surface normal to the longitudinal direction of the base material) as to the fused portion 70 and the tip 60, an area of the maximum sectional area portion of the fused portion 70 (portion of the maximum diameter of ϕD) is less than (not more than) 1.5 times of an area of an sectional area of the tip 60 positioned at the boundary surface to the fused portion 70. That is, in the present embodiment, since the tip 60 has a disc shape, the sectional area positioned on the boundary surface to the fused portion 70 corresponds to the sectional area in the diametral direction (circular section) of the tip 60. Furthermore, the sectional area along the front end surface 31 of the center electrode 30 at the fused portion 70 constitutes approximately a circular section because the disc shape tip 60 and the columnar center electrode 30 are welded.

In the example shown in FIG. 2, since the area of the maximum sectional area portion of the fused portion 70 is larger than the area of the diametrical section of the tip 60, the fused portion 70 is widened in a taper shape from the tip side towards the center electrode side and, on the center electrode side, the fused portion 70 is formed in approximately a columnar shape having the maximum diameter of ϕD.

Hereunder, in a method of manufacturing the spark plug 100 of the structure mentioned above, a joining method of the center electrode 30 and the tip 60 of the spark plug 100 will be described, and manufacturing steps of the other portions or members of the spark plug 100 are performed in known manners, so that explanations thereof will be omitted hereunder.

Figure 3C:
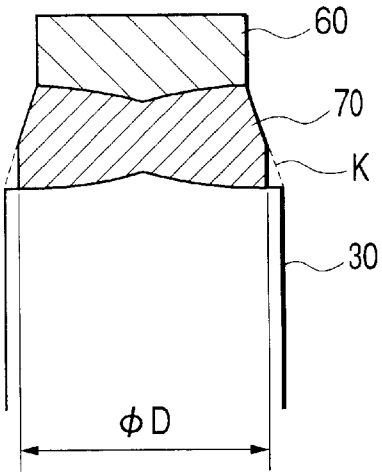
FIG. 3A to FIG. 3C are illustrations showing steps for joining the center electrode to a tip.
Figure 3B:
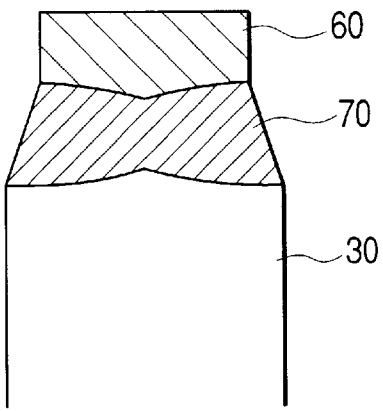
Figure 3A:
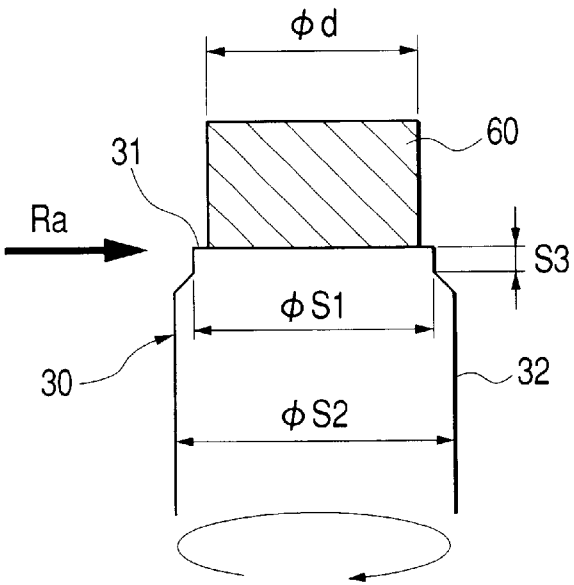

FIGS. 3A to 3C are views for explaining steps of the joining method according to the present invention.

First, with reference to FIG. 3A, a circular surface of one side of the disc-shape tip 60 is temporarily joined through resistance welding, for example, to the front end surface 31 of the center electrode 30. Further, in the illustrated example, the front end surface has a diameter ϕS1 smaller than a diameter ϕS2 of a base portion 32 of the center electrode 30.

Next, a laser beam (light) is emitted to a portion between the tip 60 and the front end surface 31 of the center electrode 30 as shown by an arrow Ra while rotating the center electrode 30.

According to the step of FIG. 3A, the fused portion 70 is formed as the mixture portion of the fused portions of the tip 60 and the center electrode 30 as shown in FIG. 3B. After the welding step, a cutting working is effected to an outer periphery of the fused portion 70 by using a blade cutter or like as shown in FIG. 3C in which the cut portion is shown with a broken line K thereby to shape the fused portion 70. According to such shaping step of the fused portion 70, the fused portion 70 is formed so as to provide the proper shape thereof as shown in FIG. 2.

As mentioned hereinbefore, with reference to the sectional area along the front end surface 31 of the center electrode 30 as to the fused portion 70 and the tip 60, the area of the maximum sectional area portion of the fused portion 70 is made smaller to be less than 1.5 times of the area of the sectional area of the tip 60. Although the present invention is not limited to such numerical definition, this matter was adopted in accordance with the following examination process as one example.

In an example, there was prepared a disc plate member, for the tip 60, composed of an Ir—Rh alloy consisting of Ir of 90 weight % and Rh of 10 weight % and having the diameter ϕd of 2.4 mm and thickness of 1.4 mm, and there was also prepared a columnar member, for the center electrode 30 as the base material, composed of Ni base alloy (INCONEL, Trademark Name) having the front end surface 31 of the diameter ϕS1 of 2.7 mm and the base portion of the diameter ϕS2 of 3.2 mm. The front end portion having the diameter 30 ϕS1 has a length S3 (0.3 mm) from the top (front) surface of the center electrode 30 as shown in FIG. 3A.

The tip 60 and the center electrode 30 thus prepared was joined by means of laser welding explained with reference to FIG. 3 and then cut and worked. According to the mentioned working steps, various members were formed and prepared by changing the maximum diameter ϕD of the fused portion 70 to ϕ2.4 mm (same as the tip diameter of ϕd), ϕ2.6 mm, ϕ2.8 mm, ϕ3.0 mm, ϕ3.2 mm - - - .

Figures 4, 5:
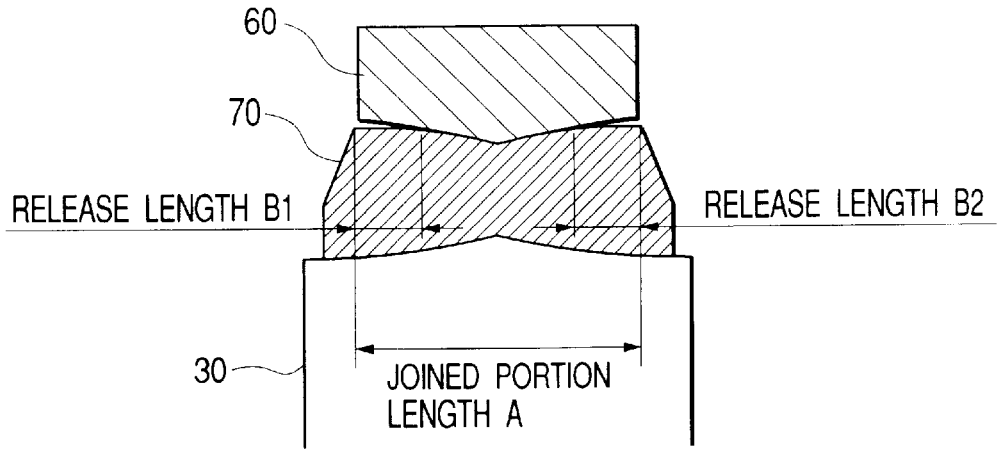
FIG. 4 is a table showing a sectional area ratio of a maximum sectional area portion of a fused (molten) portion to the tip in a diametral direction with respect to each maximum diameter ϕD (sectional area ratio between the tip and the maximum sectional portion of the fused portion)
FIG. 5 is an illustration for an explanation of release rate.

FIG. 4 is a graph representing a ratio between the area of the maximum sectional area portion of the fused portion 70 and the area of the sectional in the diametral direction of the tip 60, which will be called hereinlater "sectional area ratio of maximum portion of fused portion to tip".

In the case of the maximum diameter ϕD of the fused portion 70 being ϕ2.4 mm (same as the tip diameter of ϕd), viewing the section along the front end surface 31 of the center electrode 30, the section (sectional area) of the fused portion 70 has the same shape and dimension as those of the section in the diametral direction of the tip 60 (i.e. same circular shape). That is, the fused portion 70 is formed as a columnar portion having the diameter ϕd in the longitudinal direction thereof as like as the tip 60. On the other hand, in the case of the maximum diameter ϕD of the fused portion 70 being ϕ3.2 mm, only the laser welding was effected without performing the cutting working in the joining method mentioned above, which will correspond to a conventional product (member) showing a shape like one shown in FIG. 3B.

Spark plugs manufactured by changing the maximum diameter ϕD variously as mentioned above were mounted to six-cylinder 2000 cc engines and durability tests were performed to examine the joining condition and reliability between the tip 60 and the center electrode 30. The operating and working conditions for the durability tests were as follows: one cycle of holding an idling state for one minute and holding a throttle full-open state for one minute (6000 rpm), and this cycle was repeated for 100 hours.

Further, the joining performance was evaluated with the release rate of FIG. 5. That is, in the sectional area shown in FIG. 5, it was provided that the length of the boundary between the tip 60 and the fused portion 70 was made as joining portion length A and lengths of portions at which the tip 60 and the fused portion 70 are released from each other were made as lengths B1 and B2, and the release rate was expressed as 100(B1+B2)/A(%).

Figure 6:
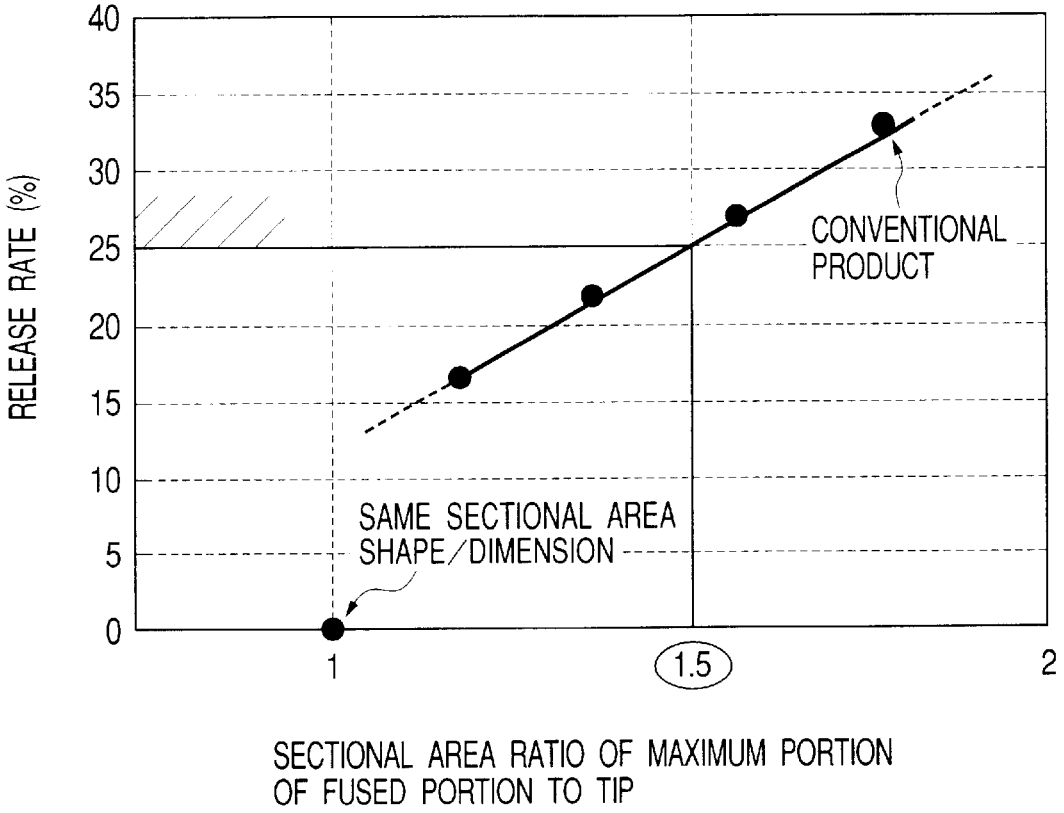
FIG. 6 is a graph representing a relationship between the ratio of FIG. 4 and the release rate of FIG. 5.

FIG. 6 is a graph in which the release rates after the durability tests were obtained with respect to the center electrodes 30 whose diameters ϕD were changed and the relationship between the "sectional area ratio of maximum portion of fused portion to tip" and the release rate (%) shown in FIG. 4 is plotted. Herein, according to the experience of the inventors, it was found that the joining reliability in practical use under the severe condition of thermal load applied to the cogeneration engine would be satisfied as far as the release rate after the durability test be less than 25%. It will be found, from the graph of FIG. 6, that it is preferred that the "sectional area ratio of maximum portion of fused portion to tip" is less than 1.5 times in order to satisfy the release rate of 25% or less.

Further, viewing the sectional area along the front end surface 31 of the center electrode 30, in the case where the sectional area of the fused portion 70 has the same shape and dimension of those of the tip 60 in its diameter direction, that is, the "sectional area ratio of maximum portion of fused portion to tip" is 1 (one time) (this case is called hereinlater "same-shape structure of fused portion and tip", the release phenomenon hardly be caused and remarkably advantageous effect can be achieved.

Therefore, according to the described embodiment of the present invention, by reducing the area of the maximum sectional area portion of the fused portion 70 to a value less than 1.5 times of the area of the sectional area in the diameter direction of the tip 60 (i.e. the sectional area of the tip positioned on the boundary between the tip and the fused portion), the thermal stress to the fused portion 70 can be reduced and the good joining performance can be ensured between the tip 60 and the center electrode (base material) 30 of the spark plug 100 even if the spark plug 100 be used under the severe thermal load condition of the cogeneration engine, for example.

Furthermore, in the described embodiment, when the "same-shape structure of fused portion and tip" is adopted, the spark plug 100 having substantially the same joining performance and reliability can be provided. Further, in the case where the sectional areas of the fused portion 70 and the tip 60 are different in their shapes and/or dimensions at the boundary portion from each other, an extruding (bleeding) portion of the tip 60 or fused portion 70 will exist. Then, an edge portion, at which the thermal stress is likely caused, is formed by the fused portion 70 and the tip 60 at such extruding portion. However, according to the "same-shape structure of fused portion and tip", since the sectional shapes and dimensions of both the tip 60 and fused portion 70 at the boundary portion are substantially the same, such edge does not exist, hence, effectively reducing the thermal stress.

Figure 7:
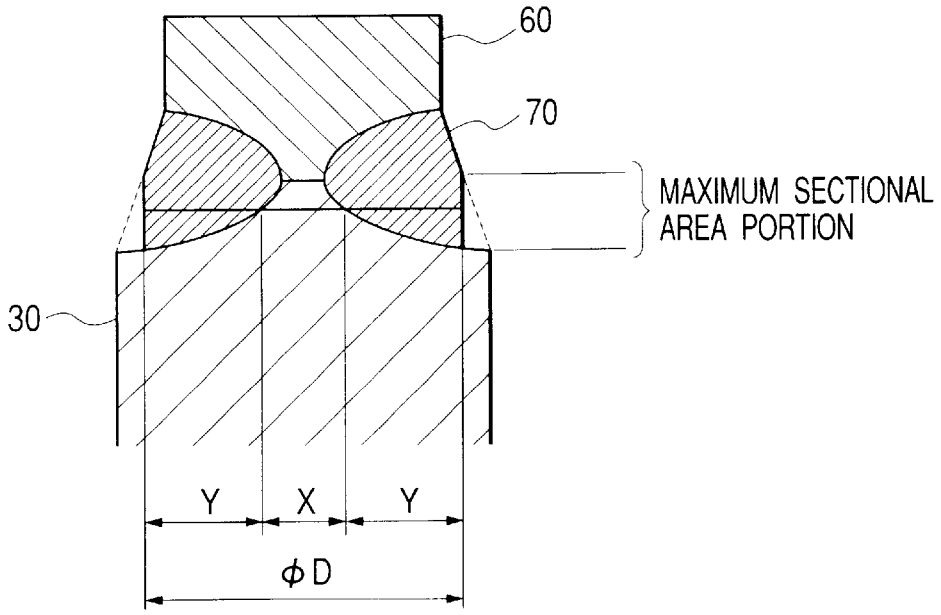
FIG. 7 is an illustrated sectional view showing a center electrode including a non-fused area X.

Furthermore, as shown in FIG. 7, even in a case where a non-fused area X, at which the tip 60 and the center electrode 30 are mixed (fused together), exists near the central portion in the diametral direction of the tip 60, the joining performance and reliability between the tip 60 and the center electrode (base material) 30 can be ensured by reducing the area of the maximum sectional area portion to not more than 1.5 times of the area of the sectional area portion in the diametral direction of the tip 60. Further, it is to be noted that the area of the maximum sectional area portion in the example of FIG. 7 includes not only the sectional area of the non-fused area X but also a sectional area of a fused area Y.

In the next stage of experiments, a spark plug having the "sectional area ratio of maximum portion of fused portion to tip" of 1.8 times (corresponding to a conventional spark plug) and a plug having the "sectional area ratio of maximum portion of fused portion to tip" of 1.0 time ("same-shape structure of fused portion and tip") were examined to obtain results of durability tests by variously changing the diametral sectional area of the tip 60. In these experiments, the materials, structures and manufacturing methods of these spark plugs were the same as those of the example mentioned above in which the maximum diameter ϕ D of the center electrode was changed variously, and moreover, the conditions and evaluation standard of the durability tests were substantially the same as those made with respect to the aforementioned example.

Figure 8:
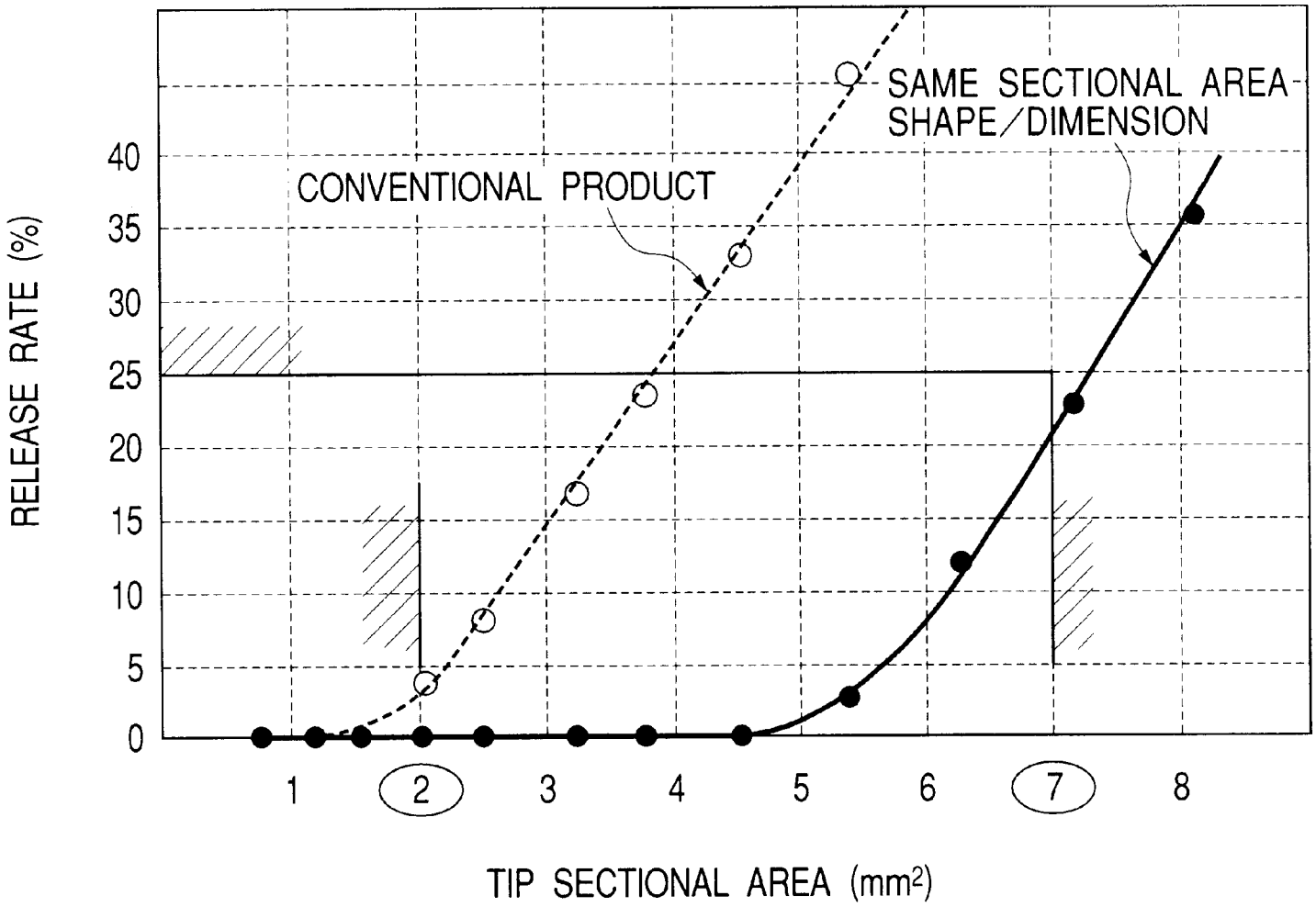
FIG. 8 is a graph representing a relationship between the tip sectional area and the release rate.

FIG. 8 represents the test result of the durability of the spark plugs manufactured with the structure mentioned above and shows a graph in which the relationship between the diametral sectional area of the tip 60 and the release rate after the durability test is plotted. As can be seen from FIG. 8, in a case where the area in the diametral section of the tip 60 is less than 2 $mm^2$, the release rate is approximately 0% irrespective of the "sectional area ratio of maximum portion of fused portion to tip", and on the other hand, in a case where the area in the diametral section of the tip 60 is more than 7 $mm^2$, the release rate exceeds 25% even in the case of the spark plug having one time (1.0 time) of "sectional area ratio of maximum portion of fused portion to tip". Accordingly, it will be said that remarkable advantageous effects and functions can be attained by providing the spark plug having the diametral sectional area of the tip 60 being more than 2 $mm^2$ and less than 7 $mm^2$ and having the "sectional area ratio of maximum portion of fused portion to tip" of less than 1.5 times.

Figures 9, 10:
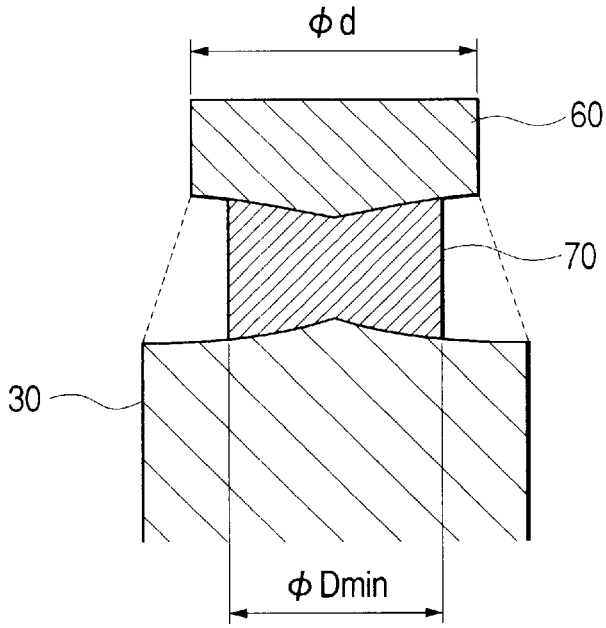
FIG. 9 is an illustrated sectional view of one example of a center electrode having a minimum diameter of the fused portion which is smaller than the diameter of a tip.
FIG. 10 is a table showing a graph representing "sectional area ratio between the minimum sectional area of the fused portion and the tip" concerning each minimum diameter ϕDmin.

Next, as shown in FIG. 9, there was prepared a spark plug having the fused portion 70 having a columnar shape having the same diameter along the tip axial direction and having a minimum diameter ϕD smaller than a diameter ϕd of the tip, and the durability tests were carried out by variously changing the sectional area ratio of the minimum sectional area of the fused portion 70 (smallest diameter portion of the fused portion 70) to the diametral sectional area of the tip 60 (called hereinlater "sectional area ratio of minimum portion of fused portion to tip".

In this connection, FIG. 10 represents a table showing the "sectional area ratio of minimum portion of fused portion to tip" in respect of each spark plug having the minimum diameter ϕ d, which was utilized for these durability tests. Further, in these experiments, the materials, structures and manufacturing methods of these spark plugs were the same as those of the example mentioned above in which the maximum diameter ϕD of the center electrode 30 was changed variously. The durability tests were carried out by using the cogeneration engine at engine speed of 1600 rpm for continuous 1000 hour with a throttle being fully opened, and the durability was evaluated with reference to the consumable volume ratio shown in FIG. 11. The consumable volume ratio is a value obtained by dividing the consumable volume of the tip 60 of a test product of spark plug for the durability test by a consumable volume ratio of a tip 60 of a conventional product of spark plug for the durability test having a shape such as shown in FIG. 3B.

Figure 11:
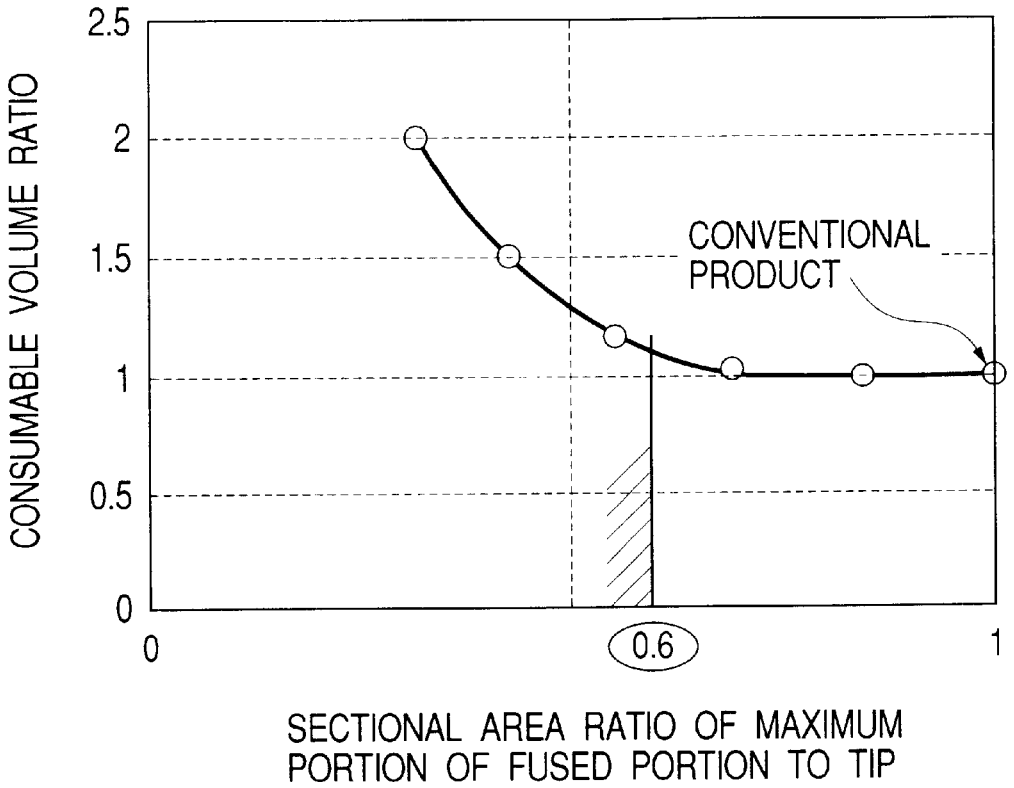
FIG. 11 is a graph representing a relationship between a consumable volume ratio and "sectional area ratio between the minimum sectional area and the tip" concerning each minimum diameter ϕDmin.

As is apparent from FIG. 11, it is preferred that the "sectional area ratio of minimum portion of fused portion to tip" is more than (not less than) 0.6 time for the reason that, in case of less than 0.6 time, the thermal conduction from the tip 60 to the base material becomes worse and, hence, tip temperature increases thereby to increase the consumption of the tip 60. In view of this fact, it will be said that consumption resistance sufficient for practical use can be ensured in the case that the "sectional area ratio of minimum portion to tip" is more than 0.6 time.

Figure 12:
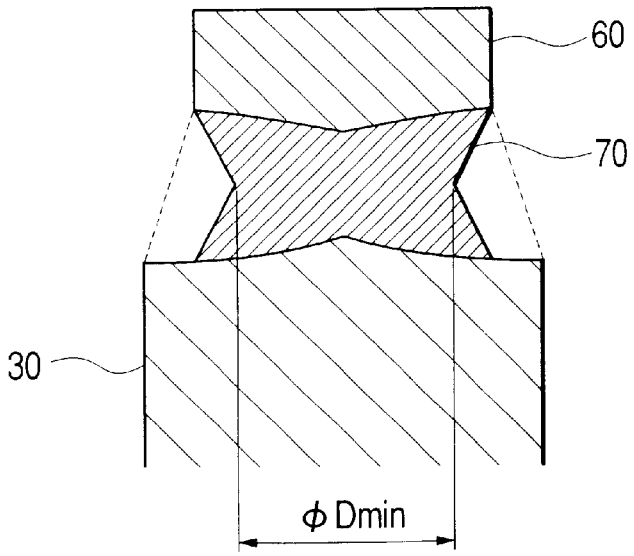
FIG. 12 is a sectional view showing one example of a center electrode having a minimum diameter of the fused portion smaller than the diameter of the tip.
Figure 13:
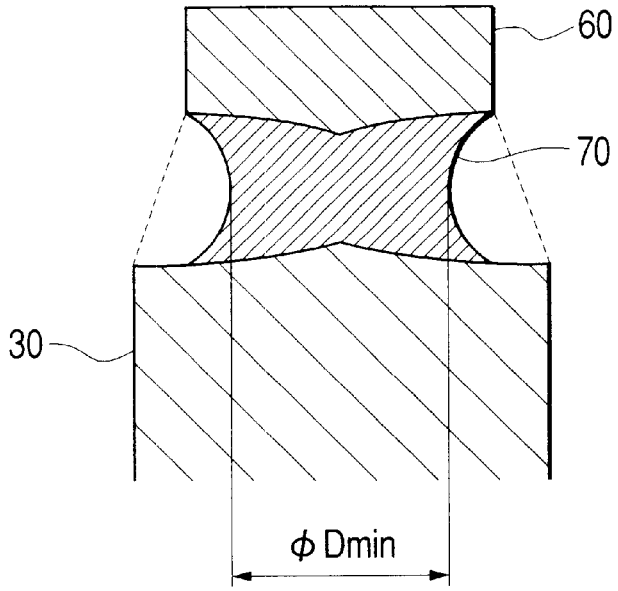
FIG. 13 is a sectional view of another example of a center electrode having a minimum diameter of the fused portion smaller than the diameter of the tip.
Figure 14:
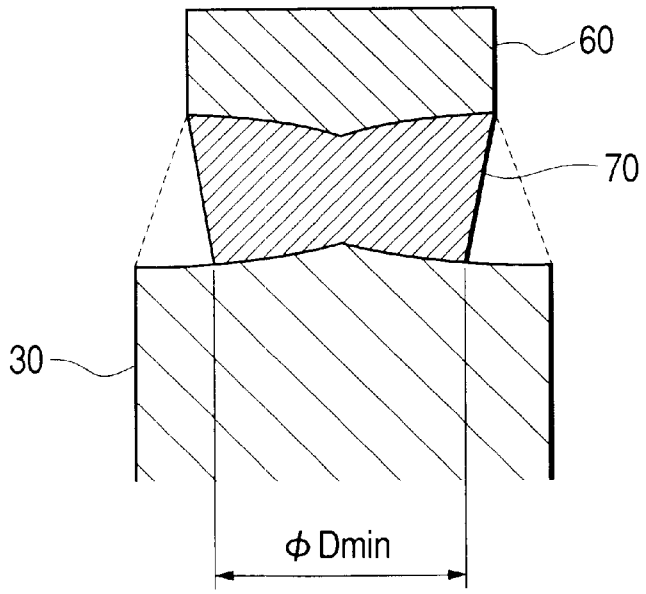
FIG. 14 is a sectional view of a further example of a center electrode having a minimum diameter of the fused portion smaller than the diameter of the tip.

For the spark plug shown in FIGS. 12 and 13, in which an intermediate portion of the fused portion 70 in the tip axial direction is made to provide the minimum diameter of ϕDmin, or a spark plug shown in FIG. 14 in which a portion of the fused portion 70 on the center electrode side is made so as to provide the minimum diameter of ϕDmin, it becomes possible to be practically usable to thereby ensure sufficient anti-abrasion property as far as the "sectional area ratio of the minimum portion to tip" is more than 0.6 time.

Figure 15:
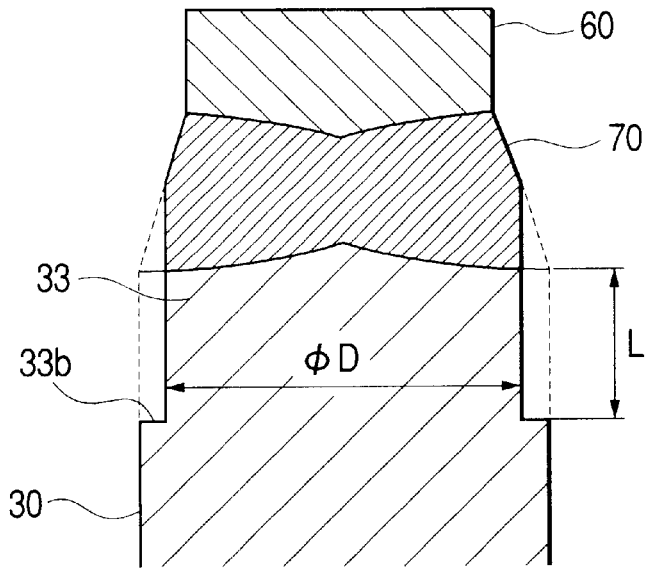
FIG. 15 is an illustrated sectional view showing one example of a center electrode to which a small sectional area portion is formed.

Furthermore, according to the present invention, a further preferred embodiment will be provided such as shown in FIG. 15, in which the center electrode 30 is formed with a small sectional area portion 33 having a length of L in the direction normal to the front end surface 31 with a starting point being the boundary portion between the center electrode 30 and the fused portion 70. This length L may be called "formation length". This small sectional area portion 33 has a sectional area along the front end surface 31 of a size less than 1.5 times with respect to the diametral sectional area of the tip 60, and in this embodiment, the sectional area along the front end surface 31 has substantially the same shape and dimension as those of the maximum sectional area portions of the fused portion 70.

The small sectional area portion 33 will be properly formed, according to the joining method shown in FIG. 3, by cutting, after the laser welding process, the fused portion 70 and a portion of the center electrode 30 adjacent to the fused portion 70 (a portion shown with broken line in FIG. 15) to thereby arrange the shape of the center electrode 30. The formation of the small sectional area portion 33 to the center electrode 30 makes it possible to provide a small-sized center electrode 30 contacting the fused portion 70 and to reduce the thermal stress applied thereto. Furthermore, it is necessary for the formation length L of the small sectional area portion 33 to be within 2.0 mm because of the following reasons.

The small sectional area portion 33 is a portion having a fine shape in comparison with the other portions of the center electrode 30, and in the case that the formation length L is too large, the center electrode 30 is made fine and, hence, the thermal conductivity will be made worse, resulting in that the center electrode 30 will be largely affected by the temperature increasing rather than the thermal stress reduction effect. Thus, the thermal stress to the fused portion 70 is increased and it is hence difficult to ensure the reliability for the joining portion.

Figure 16:
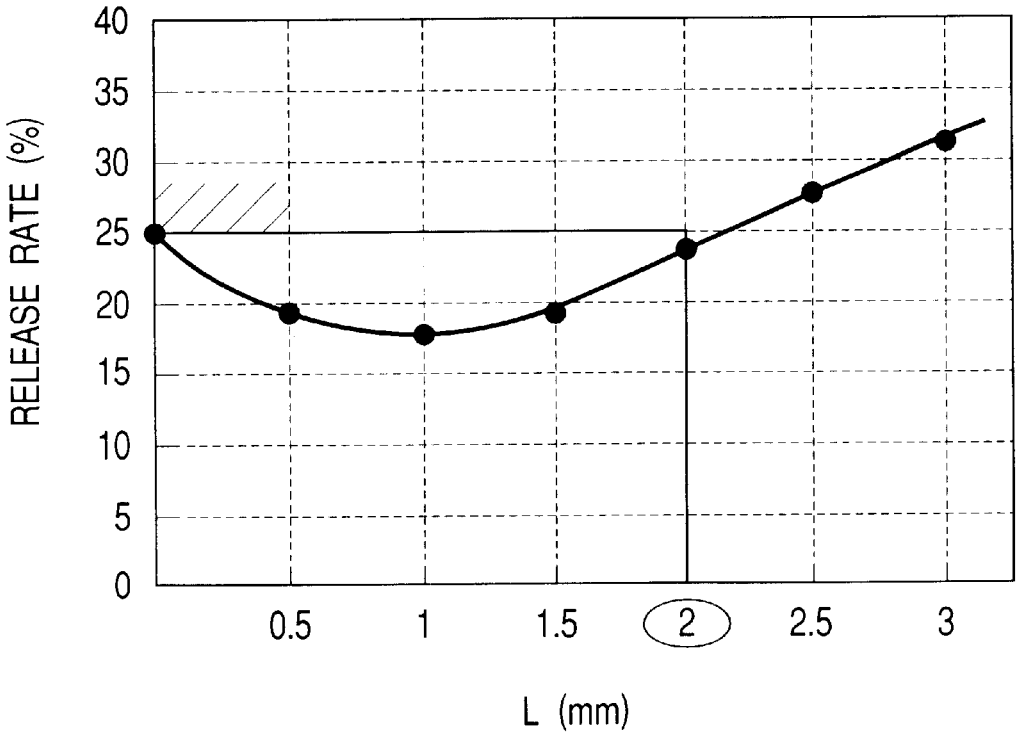
FIG. 16 is a graph showing a relationship between a release rate and a formation length L of a small sectional area portion.

Based on the above consideration, suitable range of the formation length L was obtained through the examination result mentioned above, and although this is not limited to the described one, FIG. 16 shows one example thereof. In the experiment, the tip 60 and the center electrode 30 which are similar to those shown in FIG. 4 were utilized with the "sectional area ratio of maximum portion of fused portion to tip" being of 1.5 (maximum diameter ϕd of 2.94 mm), and the formation length L was changed variously. According to such experiment, the release rate after the durability test was obtained as like in the example represented by FIG. 4.

With reference to FIG. 16 showing the relationship between the formation length L (mm) and the release rate (%), it is found out from this graph that the present embodiment can achieve the most effective function at the length (dimension) L of 0.1 mm and in the case of exceeding over this value, the center electrode 30 is affected by the temperature increasing rather than the thermal stress reduction. As a result, since the thermal stress to the fused portion 70 is increased, the release rate is also increased, and therefore, in order to make the release rate below 25%, it is preferred for the length L to be less than 2 mm.

Moreover, in the case of adopting the "same-shape structure of fused portion and tip" mentioned before, substantially the same effects as those in the case mentioned above will be achieved by the formation of such small sectional area portion 33. One example of this case is represented by the structure of FIG. 17, in which a sectional area along the front end surface 31, as the small sectional area, is formed as the same-shaped portion 33*a* having the same shape and dimension as those of the sectional area of the fused portion 70 with the formation length L of less than 2.0 mm.

Figure 17:
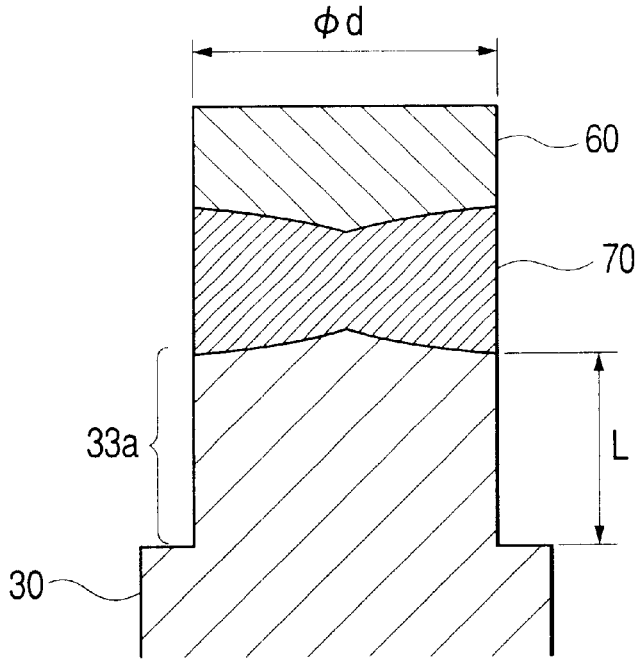
FIG. 17 is a sectional view of one example forming the same-shaped portion is formed to the center electrode as the small sectional area portion.

That is, as shown in FIG. 17, the tip 60, the fused portion 70 and the same-shaped portion (i.e. small sectional area portion) 33*a* constitute a cylindrical columnar portion having the uniform diameter ϕd throughout the axial direction thereof. Accordingly, there is provided no edge portion at the boundary portion between the center electrode 30 and the fused portion 70, thus achieving more effective function of the spark plug due to the "same-shape structure of fused portion and tip".

Figure 18:
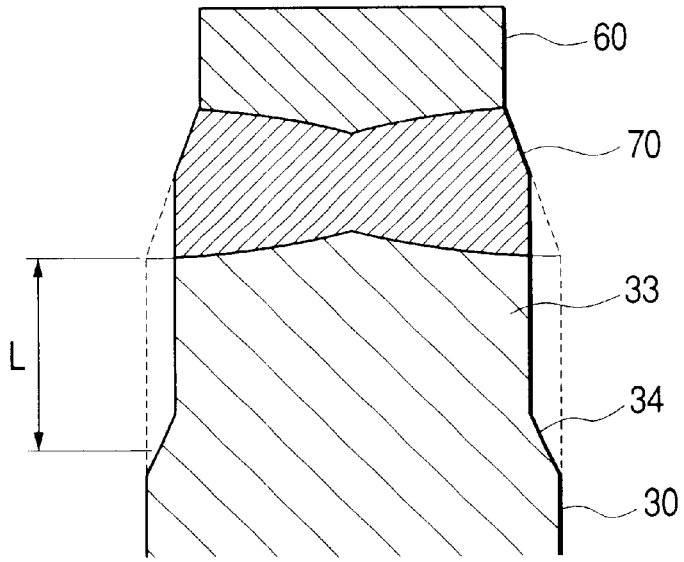
FIG. 18 is an illustrated sectional view showing another example of a center electrode to which a small sectional area portion is formed.
Figure 19:
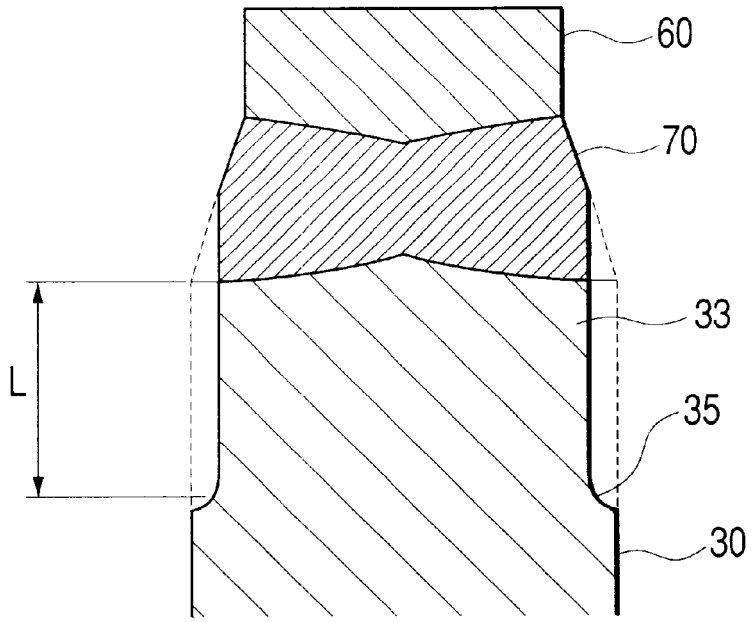
FIG. 19 is an illustrated sectional view showing a further example of a center electrode to which a small sectional area portion is formed.

Further, in the example of FIG. 15, although a stepped portion 33*b* is formed to the small sectional area portion 33 on the side opposite to the tip 60 so as to provide a flat shape in parallel to the front end surface 31 of the center electrode 30, in other examples, such stepped portion 33*b* may be formed as tapered surface portion 34, for example, as shown in FIG. 18 or formed as round surface portion 35 as shown in FIG. 19 providing an R-portion. Further, in the examples shown in FIGS. 18 and 19, the sectional area of the small sectional area portion 33 along the front end surface 31 is less than 1.5 times of the sectional area of the diametral directional section of the tip 60, so that the formation length L extends to the middle portion of the tapered surface portion 34 or round surface portion 35.

Furthermore, in the described embodiment, the tip 60 is fixedly formed to the front end surface 31 of the center electrode 30 by means of laser welding. The fused portion formed through the laser welding generally has a thickness of several μm to 1 mm, which is thicker than the thickness (generally of 10 to several ten's μm) of the fused portion formed through the usual resistance welding. Thus, although the thermal stress can be reduced as far as the thickness of the fused portion is increased, according to the present invention, the joining reliability can be further improved.

Still furthermore, for the cogeneration engine having the severe thermal load, there is usually used a disc-shaped tip having the maximum diameter of 2.4 mm, and as the tip diameter increases, the thermal stress is also increased. However, according to the present invention, an effective joining function was ensured even in the use of the tip having the diameter of 2.4 mm, and hence, the spark plug having a practically usable size provided by the present invention can achieve the advantageous function of, particularly, the joining reliability.

Second Embodiment

In the first embodiment mentioned above, the center electrode 30, which is disposed so as to oppose to the earth electrode 40, is formed as the base material, and the tip 60, as the discharge member, is welded and fixed to the front (top) end surface 31 of the center electrode 30. In this second embodiment, however, the tip 60 is welded and fixed to the earth electrode 40 thereby to attain substantially the same functions and effects as those in the first embodiment.

Figure 20:
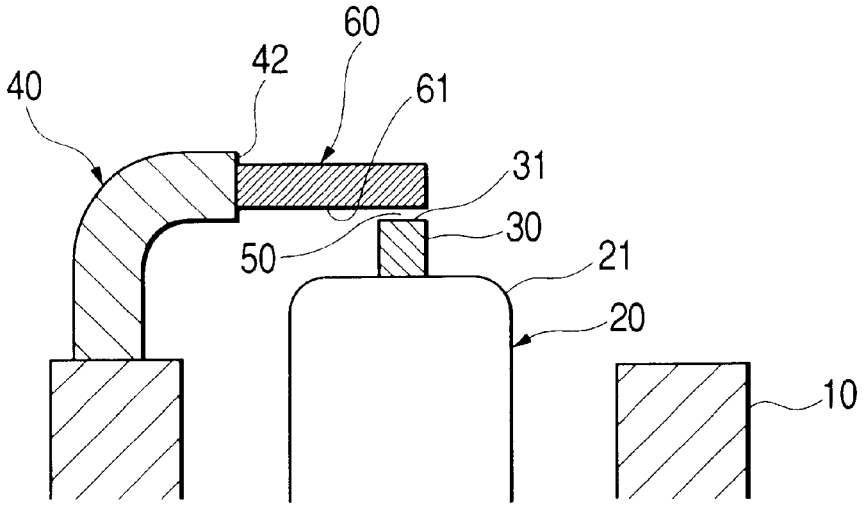
FIG. 20 is a sectional view of an essential portion of a spark plug according to a second embodiment of the present invention.

The second embodiment of the spark plug of the present invention is therefore described hereunder, with reference to FIGS. 20 to 22, only about structures or functions different from those of the first embodiment.

FIG. 20 is an illustrated sectional view of an essential portion of the spark plug of the second embodiment in an enlarged scale, in which the earth (ground) electrode 40 has one end fixed to a mounting bracket (fitting) 10 and the other end. In this embodiment, the earth electrode 40 is formed as base material and composed of an Ni base alloy so as to provide a rectangular columnar shape, and a tip 60 is fixed to a front end surface 42 (the other end portion of the base material) of the earth electrode 40 through a laser welding process. The tip 60 is composed of an Ir alloy providing a rectangular plate shape having one end surface which is joined to the front end surface 42 of the earth electrode 40. There is also formed a discharge gap 50 between the front surface portion 31 of the center electrode 30 and one surface 61 of the tip 60.

Figure 21A:
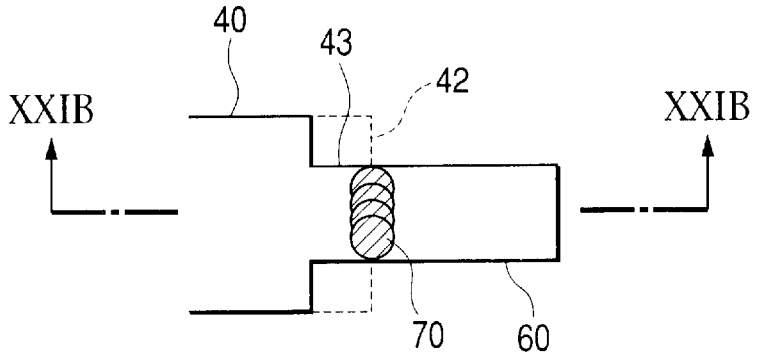
FIGS. 21A to 21D and FIGS. 22A to 22D show various examples of one end portions of earth electrode shown in FIG. 20.
Figure 21B:
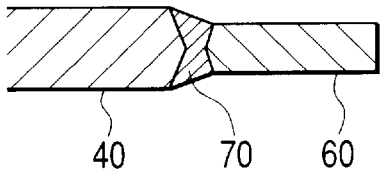
Figure 21C:
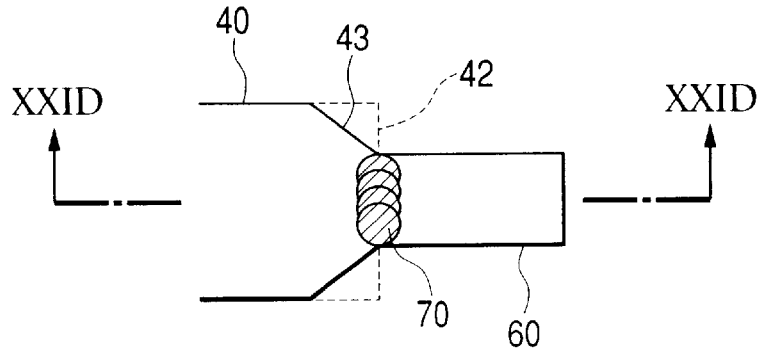
Figure 21D:
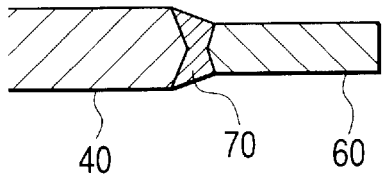
Figure 22A:
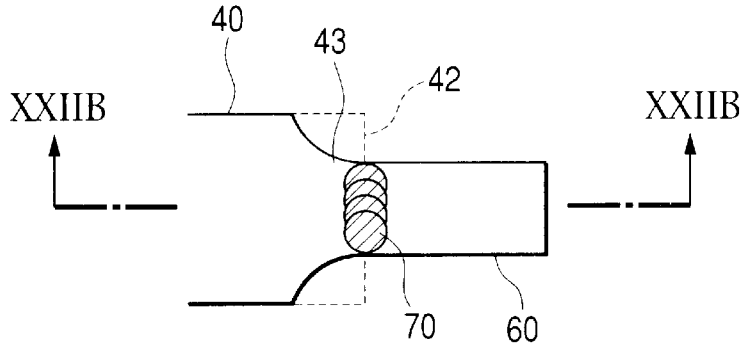
Figure 22B:
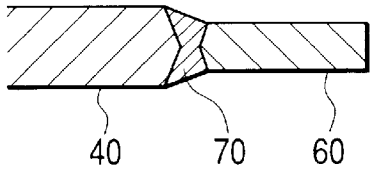
Figure 22C:
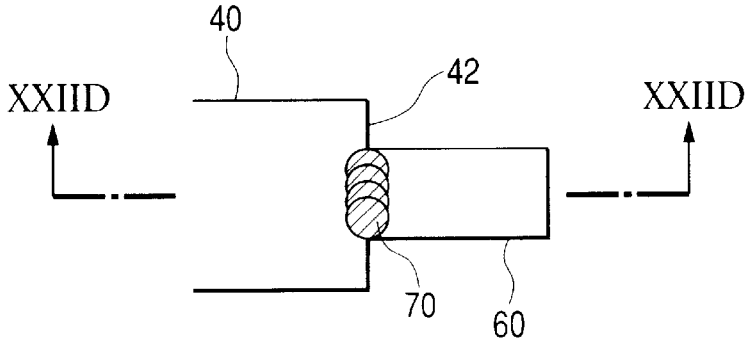
Figure 22D:
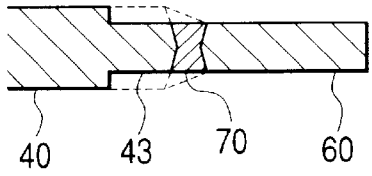

FIGS. 21 (21A to 21D) and FIGS. 22 (22A to 22D) represent examples, in enlarged scales, showing structures or shapes of the other end portions of the earth electrode 40 in FIG. 20, in which FIG. 21A shows an outer appearance of a first example, FIG. 21B is a sectional view taken along the line XXIB—XXIB in FIG. 21A, FIG. 21C shows an outer appearance of a second example, FIG. 21D is a sectional view taken along the line XXID—XXID in FIG. 21C, FIG. 22A shows an outer appearance of a third example, FIG. 22B is a sectional view taken along the line XXIIB—XXIIB in FIG. 22A, FIG. 22C shows an outer appearance of a fourth example, FIG. 22D is a sectional view taken along the line XXIID—XXIID in FIG. 22C. Further, in these figures, welded portions 70 are shown by applying hatching lines with narrow width in comparison with sectional areas shown by hatching lines with wide width.

In the examples shown in FIGS. 21 and 22, the fused portion 70 formed of the fused mixture of the tip 60 and the earth electrode 40 is formed such that, viewing the section along the front end surface 42 of the earth electrode 40 (surface normal to the longitudinal direction of the base material), the area of the maximum sectional area portion is less than (not more than) 1.5 times of the area of the section positioned to the boundary of the tip 60 to the fused portion 70. In these examples, the sectional area positioned to the boundary of the tip 60 to the fused portion 70 and the sectional area of the fused portion 70 along the front end surface 42 of the earth electrode 40 are both shown as rectangular sections.

Furthermore, these examples are formed by laser welding the tips 60 to the front end surfaces 42 of the earth electrodes 40 and then performing the cutting working to the fused portions 70 and the earth electrodes 40 (the cutout portions being shown with broken lines in FIGS. 21 and 22). According to such structures, to the cutout portions of the earth electrodes 40, there are formed small sectional area portions 43 having substantially the same functions as those of the small sectional area portions 33 in the first embodiment mentioned hereinbefore.

The first to fourth examples represented by FIGS. 21 and 22 are ones provided with the cutout portions, different in their shapes, of the earth electrodes 40 to thereby change the shapes of the small sectional area portions 43. More specifically, in the first example, both side portions in the width direction of the earth electrode 40 is cut out by the same dimension or, in the fourth example, both side portions in the thickness direction of the earth electrode 40 are cut out by the same dimension.

Furthermore, the small sectional area portions 43 in the respective examples are formed so as to extend in the direction normal to the front end surface 42 from the boundary of each fused portion 70 to the earth electrode 40 by a length within 0.2 mm. Particularly, as shown in the second and third examples, in the case where the small sectional area portions are formed so as to provide a tapered shape, the portion corresponding to the small sectional area portion has an area 1.5 times with respect to the sectional area of the tip 60 in the case of viewing the section along the front end surface 42 of the earth electrode 40.

Therefore, according to the spark plug of this second embodiment, substantially the same effects and functions as those attained by the first embodiment mentioned hereinbefore can be achieved, and furthermore, the other functions and structures of the second embodiment are substantially the same as those of the first embodiment, for example, with respect to "same-shape structure of fused portion and tip" and the same-shaped portion in the first embodiment.

Other Embodiments

In the first and second embodiments mentioned hereinabove, although the tip and the base material are joined through the laser welding, which is particularly applicable to the structure having a large-sized fused portion or portion to be fused, such joining process may be performed through a resistance welding. In the case of the resistance welding, by making the shapes and dimensions of the fused portion and the base material adjacent to the fused portion coincident with those of the above-mentioned embodiments, there can be provided a spark plug having the excellent joining reliability between the tip and the base material even in the use in sever circumstances such as under the sever thermal load.

Furthermore, the tip 60 may be welded and fixed to both the center electrode 30 and earth (ground) electrode 40, and the shape and substance or material of the tip 60 is not limited to those of the above embodiments. That is, although in the described embodiments, the substance of the tip 60 is formed of an alloy including an Ir of more than 50 weight % having a large difference in linear expansion coefficient from the base material 30 (40), Pt or Pt alloy may be utilized, and Fe alloy may be utilized for the earth electrode 40 in place of Ni alloy.

Still furthermore, although in the described embodiments, the small sectional area portions 33, 43 and the same-shaped portion 33*a* are formed through the cutting working after the welding process, such cutting working may be effected before the welding process, and furthermore, this cutting working may be substituted with a punching working or like.

Consequently, in the spark plug and the manufacturing method thereof according to the present invention, in which one of center electrode and earth electrode is formed as base material and a tip is welded and fixed to one surface of the base material.

In consideration of the fused portion between the tip and the base material and the sectional area of the tip along one surface of the tip, it is an essential matter that the sectional area of the maximum sectional area portion of the fused portion is less than (not more than) 1.5 times of the area of the section positioned between the tip and the fused portion, and the same-shaped structure of the fused portion and the tip is adopted, and the other matters or structures may be optional which are properly changed as occasion demands.

What is claimed is:

1. A spark plug for an engine comprising:

a mounting member made of a conductive material which is mounted to an engine;

an insulator disposed inside the mounting member and formed with an axial hole;

a center electrode formed of a metal material and disposed in the axial hole of the insulator in a manner insulated from the mounting member; and an earth electrode disposed so as to oppose to the center electrode, at least one of said center electrode and earth electrode being formed as a base material having one surface to which a tip composed, as a discharge member, of a noble metal or alloy thereof is welded and fixed thereto through a fused portion, wherein said fused portion between the tip and the base material has an area of a maximum sectional area portion of a size of not more than 1.5 times a sectional area of a portion of the tip positioned at a boundary portion to the fused portion, and the sectional area of the tip positioned at the boundary portion is not less than 2 $mm^2$ and not more than 7 $mm^2$.

2. A spark plug according to claim 1, wherein said fused portion has a minimum sectional area portion having an area of a size of not less than 0.6 time the sectional area of the tip positioned at the boundary portion to the fused portion.

3. A spark plug according to claim 1, wherein said base material has a sectional area, as a small sectional area portion, along one surface thereof, which has a size of not more than 1.5 times the sectional area of the portion of the tip positioned at the boundary portion to the fused portion, said small sectional area portion being formed so as to provide a formation length of not more than 2.0 mm in a direction normal to the one surface of said base material from the boundary portion between the base material and the fused portion.

4. A spark plug according to claim 1, wherein said tip is fixed to the one surface of the base material through a laser welding.

5. A spark plug according to claim 1, wherein said tip is formed of an alloy including Ir of not less than 50 weight %.

6. A spark plug according to claim 1, wherein said fused portion between the tip and the base material has a sectional area having shape and size substantially the same as those of a sectional area of a portion of the tip positioned at a boundary portion to the fused portion.

7. A spark plug according to claim 6, wherein said base material has a sectional area, as a same-shaped portion, along one surface thereof, which has shape and size substantially the same as those of the sectional area of the fused portion, said same-shaped portion being formed so as to provide a formation length of not more than 2.0 mm in a direction normal to the one surface of the base material from the boundary portion between the base material and the fused portion.

8. A spark plug according to claim 6, wherein said tip is fixed to the one surface of the base material through a laser welding.

9. A spark plug according to claim 6, wherein said tip is formed of an alloy including Ir of not less than 50 weight %.

* * * * *